US011299907B1

(12) United States Patent
Hudrlik et al.

(10) Patent No.: US 11,299,907 B1
(45) Date of Patent: Apr. 12, 2022

(54) COLLAPSIBLE CANOPY AND COLLAPSIBLE CANOPY FRAME

(71) Applicant: CARAVAN CANOPY INT'L, INC., La Mirada, CA (US)

(72) Inventors: Jason Scott Hudrlik, Lakewood, CA (US); David Charles Hudrlik, Brea, CA (US)

(73) Assignee: Caravan Canopy Int'l, Inc., La Mirada, CA (US)

( * ) Notice: Subject to any disclaimer, the term of this patent is extended or adjusted under 35 U.S.C. 154(b) by 0 days.

(21) Appl. No.: 17/098,005

(22) Filed: Nov. 13, 2020

(51) Int. Cl.
*E04H 15/50* (2006.01)
*E04H 15/46* (2006.01)

(52) U.S. Cl.
CPC ..... *E04H 15/50* (2013.01); *E04H 15/46* (2013.01)

(58) Field of Classification Search
CPC ..... E04H 15/50; E04H 15/48; E04H 15/505
See application file for complete search history.

(56) References Cited

U.S. PATENT DOCUMENTS

| | | | | |
|---|---|---|---|---|
| 7,299,813 | B2 * | 11/2007 | Ochi | E04H 15/50 135/131 |
| 7,571,737 | B2 * | 8/2009 | Jang | E04H 15/50 135/131 |
| 7,836,908 | B2 * | 11/2010 | Sy-Facunda | E04H 15/50 135/145 |
| 8,590,553 | B2 * | 11/2013 | Lovley, II | E04H 15/50 135/120.2 |
| 9,303,428 | B1 * | 4/2016 | Wu | E04H 15/50 |
| 9,845,614 | B2 * | 12/2017 | Huang | E04H 15/46 |
| 9,995,057 | B2 * | 6/2018 | Wu | E04H 15/405 |
| 10,041,272 | B2 * | 8/2018 | Choi | E04H 15/50 |
| 2015/0247339 | A1 * | 9/2015 | Lee | E04H 15/50 135/145 |
| 2019/0368220 | A1 * | 12/2019 | Sun | E04H 15/18 |
| 2021/0102399 | A1 * | 4/2021 | Tomchak | E04H 15/50 |

* cited by examiner

*Primary Examiner* — David R Dunn
*Assistant Examiner* — Danielle Jackson
(74) *Attorney, Agent, or Firm* — Lewis Roca Rothgerber Christie LLP

(57) ABSTRACT

A collapsible canopy frame including a plurality of side poles including a first side pole, a second side pole, and a third side pole, a first set of edge scissor assemblies coupling the first side pole and the second side pole to each other, at least one second edge scissor assembly coupling the second side pole and the third side pole to each other, and a hub coupled to the first side pole and the second side pole by the first set of edge scissor assemblies and coupled to the third side pole by a hub rib pole, the hub rib pole extending between the hub and an upper end of the third side pole.

19 Claims, 12 Drawing Sheets

COLLAPSIBLE CANOPY AND COLLAPSIBLE CANOPY FRAME

BACKGROUND

1. Field

Aspects of embodiments of the present disclosure relate to a collapsible canopy and a collapsible canopy frame.

2. Description of the Related Art

Collapsible canopy frames often include a plurality of telescoping legs and one or more scissor assemblies (e.g., X-shaped scissor assemblies) extending therebetween. A canopy covering, such as a cloth, polyester, or leather covering, is disposed above, and supported by, the collapsible canopy frame. The scissor assemblies are moveable relative to the telescoping legs to adjust the collapsible canopy frame between an expanded position and a collapsed position.

Typically, collapsible canopy frames have a central support member that supports the canopy covering, creating a pyramidal shape. For example, in the typical scissor assembly canopy frame described above, the frame may include a central support member. As the scissor assemblies are expanded, the central support member is raised into a vertical supporting position and may have an extendable vertical pole member that is used to support a canopy and provide a peak for the canopy.

However, as collapsible canopies have become increasingly popular for sporting events, festivals, trade shows, and other gatherings, a variety of collapsible canopies may be desirable. For ease of use, canopy frames having reduced weight, a reduced size, and/or a different shape while still providing a strong and stable foundation may be desirable.

The above information disclosed in this Background section is for enhancement of understanding of the background of the present disclosure, and, therefore, it may contain information that does not constitute prior art.

SUMMARY

One or more embodiments of the present disclosure are directed to a collapsible canopy frame. Further, one or more embodiments of the present disclosure are directed to a collapsible canopy.

In an one embodiment of the present disclosure a collapsible canopy frame is provided that includes: a plurality of side poles including a first side pole, a second side pole, and a third side pole; a first set of edge scissor assemblies coupling the first side pole and the second side pole to each other; at least one second edge scissor assembly coupling the second side pole and the third side pole to each other; and a hub coupled to the first side pole and the second side pole by the first set of edge scissor assemblies and coupled to the third side pole by a hub rib pole, the hub rib pole extending between the hub and an upper end of the third side pole.

In one embodiment, the hub, the first side pole, the second side pole, and the first set of edge scissor assemblies are located at a side area of the canopy frame.

In one embodiment, the collapsible canopy frame further includes a support member coupling the hub rib pole to the third side pole.

In one embodiment, each of the side poles is a telescoping side pole.

In one embodiment, the collapsible canopy frame further includes a first bracket coupling the hub rib pole to the third side pole.

In one embodiment, the collapsible canopy frame further includes a first bracket coupling an upper end of a scissor assembly of the at least one second edge scissor assembly to the third side pole and a second bracket coupling a lower end of the scissor assembly of the at least one second edge scissor assembly to the third side pole.

In one embodiment, the second bracket couples a support member to the third side pole.

In one embodiment, the first bracket is at or near a top end of the third side pole, and the second bracket is positioned below the first bracket on the third side pole.

In one embodiment, the first bracket is fixed to the third side pole.

In one embodiment, the second bracket is configured to slide along the third side pole.

In one embodiment, the first set of edge scissor assemblies coupling the first side pole and the second side pole to each other includes a first scissor assembly, a second scissor assembly, a third scissor assembly, and a fourth scissor assembly sequentially arranged to couple the first side pole and the second side pole to each other.

In one embodiment, the hub is coupled to an upper end of the second scissor assembly and an upper end of the third scissor assembly.

In one embodiment, the first scissor assembly and the fourth scissor assembly have a same length.

In one embodiment, the second scissor assembly and the third scissor assembly have a same length.

In one embodiment, the first scissor assembly and the second scissor assembly are different in length.

In one embodiment, the first scissor assembly is greater in length than the second scissor assembly.

In one embodiment, the plurality of side poles further includes a fourth side pole, and the canopy frame further includes: a third set of edge scissor assemblies coupling the third side pole and the fourth side pole to each other; and at least one fourth edge scissor assembly coupling the first side pole and the fourth side pole to each other.

In one embodiment, the third set of edge scissor assemblies includes a different number of edge scissor assemblies than the first set of edge scissor assemblies.

In one embodiment, the first side pole and the second side pole are spaced apart from each other by a same distance as the third side pole and the fourth side pole when the canopy frame is in an expanded state.

In one embodiment, a canopy covering may be on the collapsible canopy frame. The canopy covering includes a roof portion and a wall portion, and a gap is defined between the wall portion and a lower end of the first side pole of the plurality of side poles when the canopy frame is in a raised configuration.

This summary is provided to introduce a selection of features and concepts of example embodiments of the present disclosure that are further described below in the detailed description. This summary is not intended to identify key or essential features of the claimed subject matter nor is it intended to be used in limiting the scope of the claimed subject matter. One or more of the described features according to one or more example embodiments may be combined with one or more other described features according to one or more example embodiments to provide a workable method or device.

DETAILED DESCRIPTION

Figure 1:
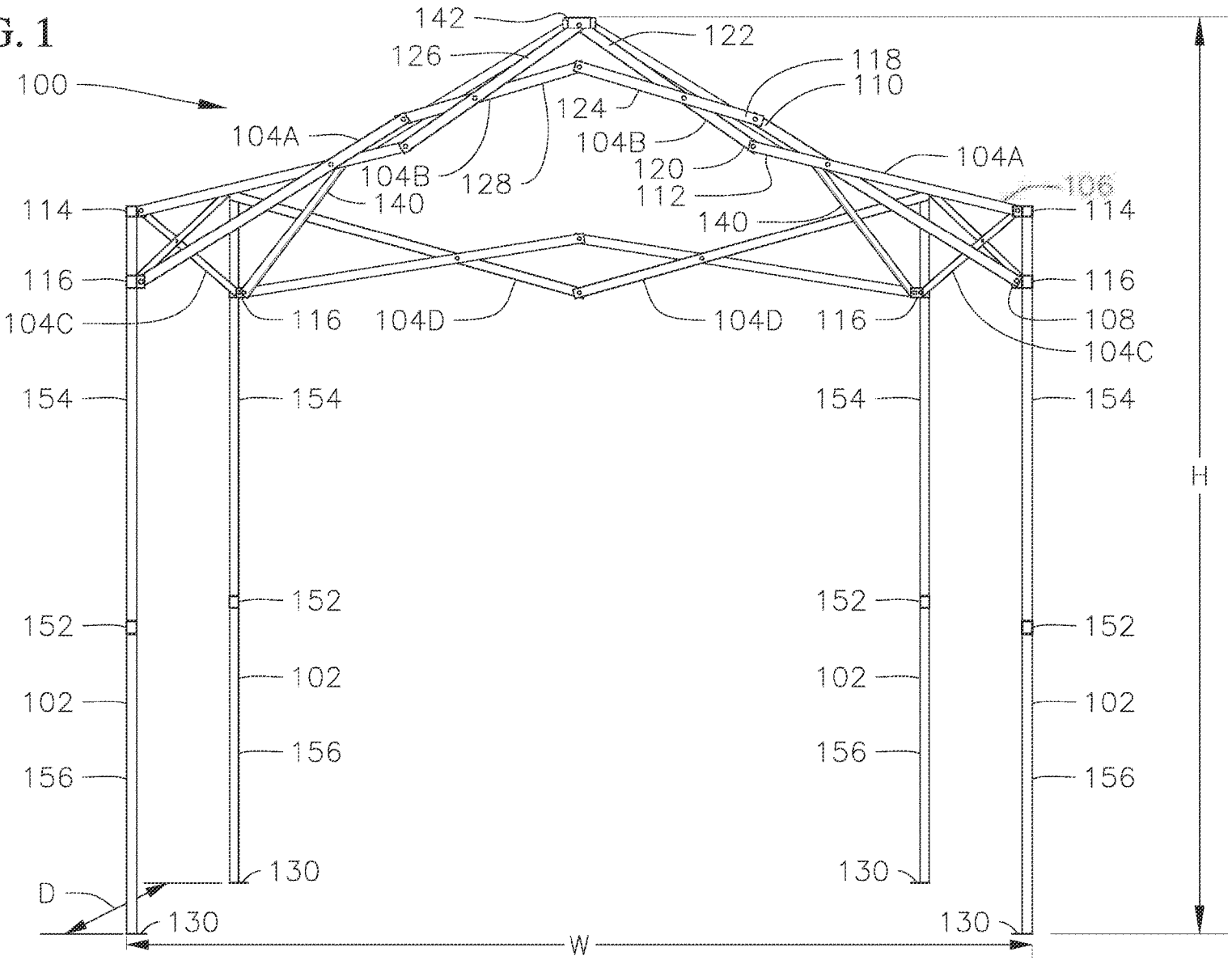
FIG. 1 is a front perspective view of a canopy frame in a fully expanded state and in a raised configuration according to one or more embodiments of the present disclosure.

Hereinafter, example embodiments of the present disclosure will be described, in more detail, with reference to the accompanying drawings. The present disclosure, however, may be embodied in various different forms and should not be construed as being limited to only the embodiments illustrated herein. Rather, these embodiments are provided as examples so that this disclosure will be thorough and complete and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and, thus, descriptions thereof may not be repeated.

In the drawings, the relative sizes of elements, layers, and regions may be exaggerated and/or simplified for clarity.

As used herein, the singular forms "a," "an," and "the" are intended to include the plural forms as well, unless the context clearly indicates otherwise.

It is to be further understood that the terms "includes," "including," "comprises," and/or "comprising," when used in this specification, specify the presence of stated features, steps, operations, elements, and/or components, but do not preclude the presence or addition of one or more other features, steps, operations, elements, components, and/or groups thereof.

As used herein, the term "and/or" includes any and all combinations of one or more of the associated listed items.

Further, the use of "may" when describing embodiments of the present disclosure refers to "one or more embodiments of the present disclosure".

It is to be understood that when an element is referred to as being "on," "connected to," or "coupled to" another element, it may be directly on, connected, or coupled to the other element or one or more intervening elements may also be present. When an element is referred to as being "directly on," "directly connected to," or "directly coupled to" another element, there are no intervening elements present.

Spatially relative terms, such as "beneath," "below," "lower," "above," "upper," "bottom," "top," and the like, may be used herein for ease of description to describe one element or feature's relationship to another element(s) or feature(s) as illustrated in the drawings. It is to be understood that the spatially relative terms are intended to encompass different orientations of the device in use or operation in addition to the orientation depicted in the drawings. For example, if the device in the drawings is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly.

As used herein, the terms "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Unless otherwise defined, all terms (including technical and scientific terms) used herein have the same meaning as commonly understood by one of ordinary skill in the art to which the present disclosure belongs. It is to be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a front perspective view of a canopy frame in a fully expanded state and in a raised configuration according to one or more embodiments of the present disclosure.

Referring to FIG. 1, a collapsible canopy frame 100 according to one or more embodiments of the present disclosure includes side poles 102 to support the canopy frame 100 and one or more edge scissor assemblies 104A, 1046, 104C, 104D connecting each of the side poles 102 to another one of the side poles 102. Each of the edge scissor assemblies 104A, 104B, 104C, 104D may be formed of a pair of scissor members pivotably coupled together and rotatable about a pivot, and each of the side poles 102 may be connected to two other side poles 102 adjacent to the side pole 102 by separate sets of one or more edge scissor assemblies. For example, a single set of one or more edge scissor assemblies may connect two side poles 102 to each other.

In one or more embodiments, the set of one or more edge scissor assemblies connecting two side poles may include one or more edge scissor assemblies 104C, 104D that include the pair of scissor members pivotably coupled to each other at a center of each of the pair of scissor members (i.e., the pair of scissor members may have a pivot point at a center of each of the pair of scissor members) or may include one or more edge scissor assemblies 104A, 1046 that include the pair of scissor members pivotably coupled to each other at a location off-center from each of the pair of scissor members (i.e., the pair of scissor members may each have a pivot point located between a center and an end of each of the pair of scissor members). For example, each of the pair of scissor members in three sets of one or more edge scissor assemblies may include a pair of scissor members pivotably coupled to each other at a center of each of the pair of scissor members, and at least one of the pair of scissor members in another set of one or more edge scissor assemblies may include a pair of scissor member pivotably coupled to each other at a location off-center from each of the pair of scissor members (e.g., as shown in FIGS. 2A-2D).

As shown in FIG. 1, the canopy frame 100 may include four sets of edge scissor assemblies connecting four side poles 102 to each other. Two sets of the four sets of edge scissor assemblies include a single edge scissor assembly 104C (e.g., a single edge scissor assembly including a pair of scissor members that are pivotably coupled to each other at a center of each of the pair of scissor members), one set of the four sets of edge scissor assemblies includes two edge scissor assemblies 104D (e.g., two edge scissor assemblies each including a pair of scissor members that are pivotably coupled to each other at a center of each of the pair of scissor members), and one set of the four sets of edge scissor assemblies includes four edge scissor assemblies 104A, 104B (e.g., four edge scissor assemblies each including a pair of scissor members that are pivotably coupled to each other at a location off-center from each of the pair of scissor members). In one or more embodiments, the two edge scissor assemblies 104D of one set of edge scissor assemblies and the four edge scissor assemblies 104A, 1046 of another one of the set of edge scissor assemblies are different in length such that each of the sets of edge scissor assemblies connect a pair of corresponding side poles 102 that are spaced apart from each other via the sets of edge scissor assemblies by the same distance (e.g., in an expanded state and in a collapsed state).

As shown in FIG. 1, the edge scissor assemblies 104A, 104B, 104C, 104D have a first side with an upper outer end 106, 118, or 126 and a lower outer end 108, 120, or 128 and a second side opposing the first side with an upper outer end 110 or 122 and a lower outer end 112 or 124. The upper and the lower outer ends of the first and the second sides may be pivotably coupled to either another edge scissor assembly 104A, 104C, 104D by pivots or pivotably coupled to a side pole 102 by a first bracket 114 and a second bracket 116 mounted on a side pole 102 as will be described in more detail below.

In one or more embodiments, each of the one or more edge assemblies 104B may include a pair of scissor members with a first one of the pair of scissor members having a length of about 15 inches and a second one of the pair of scissor members having a length of about 17 inches. In other words, the length from the lower outer end 120 of the edge scissor assembly 1046 to the upper outer end 122 of the edge scissor assembly 1046 may be about 17 inches, and the length from the upper outer end 118 of the edge scissor assembly 1046 to the lower outer end 124 of the edge scissor assembly 1046 may be about 15 inches. In this case, the pivot of the edge scissor assembly 1046 coupling the pair of scissor members to each other may be located about 9 inches from the pivot coupling another edge scissor assembly 1046 to the upper outer end 122 of the edge scissor assembly 104B and about 8 inches from the pivot coupling another edge scissor assembly 104A to the lower outer end 124 of the edge scissor assembly 1046.

In one or more embodiments, each of the one or more edge assemblies 104A may include a pair of scissor members with a first one of the pair of scissor members having a length of about 26 inches. In other words, the length from the lower outer end 112 of the edge scissor assembly 104A to the upper outer end 106 of the edge scissor assembly 104A may be about 26 inches. In this case, the pivot of the edge scissor assembly 104A coupling the pair of scissor members to each other may be located about 8 inches from the pivot coupling another edge scissor assembly 1046 to the lower outer end 112 of the edge scissor assembly 104A and about 18 inches from the pivot coupling the first bracket 114 to the upper outer end 106 of the edge scissor assembly 104A.

Although a specific number of edge scissor assemblies 104A, 104B, 104C, 104D with specific lengths included in a set of edge scissor assemblies has been provided, any suitable number of edge scissor assemblies 104A, 104B, 104C, 104D with any suitable length may be used depending on the distance between connected side poles 102, the dimensions of the edge scissor assemblies 104A, 104B, 104C, 104D, and the like.

In one or more embodiments, each of the side poles 102 has a substantially square cross-section, although the present disclosure is not limited thereto, and a foot bracket 130 attached at a bottom end of the side pole 102 for supporting the weight of the canopy frame 100. The side poles 102 may be spaced apart from each other such that a rectangular shaped covered area may be covered by a canopy covering resting on or attached to the canopy frame 100 when the canopy frame 100 is in a fully expanded state. Further, when the canopy frame 100 is in the fully expanded state, the side poles 102 may extend vertically or in the height direction and provide further support for the weight of the canopy frame 100 and the canopy covering. However, the present disclosure is not limited thereto, and in other embodiments, the side poles 102 may be slanted relative to a height direction (e.g., a direction normal or perpendicular to the ground) of the canopy frame 100 which further expands the rectangular shaped covered area.

As shown in FIG. 1, the rectangular shaped covered area may have two opposing, parallel long sides corresponding to a width W and two opposing, parallel short sides corresponding to a depth D. Further, the canopy frame 100 may have a height H. The width W, the depth D, and the height H may be set to any suitable width, depth, and height respectively with corresponding changes to, for example, the side poles 102 and/or the sets of edge scissor assemblies.

In one or more embodiments, each of the side poles 102 has a first bracket 114 and a second bracket 116 mounted thereon. The first bracket 114 may be mounted at a top end of each of the side poles 102 and the second bracket 116 may be mounted at a side portion of the side pole 102 between the top end and the bottom end of the side pole 102. Because the first bracket 114 may be at the top end of each of the side poles 102 and the foot bracket 130 may be at the bottom end of each of the side poles 102, the first bracket 114 and the foot bracket 130 may be at opposite ends of each of the side poles 102.

In one or more embodiments, the first bracket 114 positioned above the second bracket 116 near or at the top of the side pole 102 may be stationary or fixed while the second bracket 116 may be movable with respect to the side pole 102. Therefore, the second bracket 116 may move or slide as the canopy frame 100 changes between the collapsed state and the fully expanded state.

Each of the first bracket 114 and the second bracket 116 may pivotably couple an edge scissor assembly 104A, 104C, 104D to a corresponding one of the side poles 102. For example, an upper outer end 106 of one edge scissor assembly 104A, 104C, 104D may be pivotably coupled to the corresponding side pole 102 by the first bracket 114, and a lower outer end 108 of the one edge scissor assembly 104A, 104C, 104D may be pivotably coupled to the corresponding side pole 102 by the second bracket 116. In one or more embodiments, the first bracket 114 and the second bracket 116 may each include a first connection region, a second connection region, and a third connection region (the connection regions 132, 134, 136 of the first bracket 114 are shown and described in more detail with respect to FIG. 3 below). Edge scissor assemblies 104A, 104C, 104D from separate sets of edge scissor assemblies may pivotably couple to the first bracket 114 at the first connection region 132 and the third connection region 136, and a hub rib pole 138 may pivotably couple to the first bracket 114 at the second connection region 134. The edge scissor assemblies 104A, 104C, 104D from separate sets of edge scissor assemblies may pivotably couple to the second bracket 116 at the first connection region and the third connection region, and a support member 140 may pivotably couple to the second bracket 116 at the second connection region. The support member 140 may support the hub rib pole 138 as will be discussed in more detail below.

In one or more embodiments, the collapsible canopy frame 100 may further include a hub 142 connected to each of the side poles 102 by a hub rib pole 138 or one or more scissor assemblies 104A, 104B. The hub 142, one or more scissor assemblies 104A, 104B connecting the hub 142 to two adjacent side poles 102, and the two adjacent side poles 102 may define the boundaries of a side area (e.g., a planar side area). In one or more embodiments, the hub 142 may be centered between the two adjacent side poles 102 at the side area.

As shown in FIG. 1, the first bracket 114 and the second bracket 116 of the two adjacent side poles 102 at the side area may pivotably couple only edge scissor assemblies 104A, 104C to corresponding side poles 102 of the two adjacent side poles 102, the first bracket 114 of other side poles 102 may pivotably couple edge scissor assemblies 104D, 104C and a hub rib pole 138 to corresponding side poles 102, and the second bracket 116 of the other side poles 102 may pivotably couple edge scissor assemblies 104D, 104C and a support member 140 to the corresponding side poles 102.

The hub 142 may include four coupling support members 144, 146, 148, 150 at an underside of the hub 142 (the coupling support members 144, 146, 148, 150 of the hub 142 are shown and described in more detail with respect to FIGS. 4A and 4B below). Two edge scissor assemblies 104B may respectively connect to the hub 142 using two coupling support members 144, 146 from among the four coupling support members 144, 146, 148, 150, and two hub rib poles 138 may respectively connect to the hub 142 using the two other coupling support members 148, 150 of the four coupling support members 144, 146, 148, 150. In one or more embodiments, the coupling support members 144, 146 for the two edge scissor assemblies 104A may be side-by-side such that a single pivot may couple each of the two coupling support members 144, 146 and upper outer ends 122, 126 of the two edge scissor assemblies 104B together. Lower outer ends 124, 128 of the two edge scissor assemblies 104B connected to the hub 142 may be spaced apart from the hub 142 and may be coupled together by another pivot. The two hub rib poles 138 that may be respectively connected at the other two coupling support members 148, 150 of the hub 142 may extend to corresponding side poles 102 spaced apart from the side area formed by the hub 142 and the two adjacent side poles 102.

Although a specific number of coupling support members for the hub 142 are described, the present disclosure is not limited thereto. For example, the number of coupling support members at the underside of the hub 142 may vary depending on the number of hub rib poles 138 extending from corresponding side poles 102 of the canopy frame 100 to support the hub 142.

In one or more embodiments, the set of one or more side poles 102 at the side area of the canopy frame 100 may include four edge scissor assemblies 104A, 1046 sequentially connected to each other from one side pole 102 at the side area to another, adjacent side pole 102 at the side area with the hub 142 connected between two of the four edge scissor assemblies 104A, 104B. For example, a first pair of edge scissor assemblies 104A may be pivotably coupled to separate ones of the two adjacent side poles 102 via corresponding first brackets 114 and second brackets 116 of the two adjacent side poles 102 as shown in FIG. 1. The first pair of edge scissor assemblies 104A may also be connected to respective ones of a pair of intervening edge scissor assemblies 1046 connected between the first pair of edge scissor assemblies 104A. The hub 142 may be coupled to an upper outer end 122, 126 of the pair of intervening edge scissor assemblies 1046 by a pivot.

In one or more embodiments, the pair of intervening edge scissor assemblies 1046 may each have scissor members that are the same length as each other and the pair of intervening edge scissor assemblies 1046 may be the same length as each other. The pair of edge scissor assemblies 104A may each have scissor members that are the same length as each other and the pair of edge scissor assemblies 104A may be the same length as each other. Further, the scissor members of the pair of intervening edge scissor assemblies 104B may be shorter in length than the scissor members of the pair of edge scissor assemblies 104A. However, the present disclosure is not limited thereto, and in other embodiments, the scissor members of the pair of intervening edge scissor assemblies 104B may be greater in length than the scissor members of the pair of edge scissor assemblies 104A.

A hub rib pole 138 may include an upper section 158 having a first end and a second end opposite the first end, and a lower section 160 having a first end and a second end opposite to the first end (the upper section 158 and the lower section 160 of the hub rib pole 138 are shown and described in more detail with respect to FIGS. 2A and 2B below). The first end of the upper section 158 of the hub rib pole 138 may be coupled to the hub 142 at a coupling support member 148 of the hub 142 by a pivot. The second end of the upper section 158 of the hub rib pole 138 may be coupled to the first end of the lower section 160 of the hub rib pole 138 by a pivot, and the second end of the lower section 160 of the hub rib pole 138 may be pivotably coupled to a side pole 102 by the first bracket 114 mounted on the side pole 102.

In one or more embodiments, the lower section 160 of the hub rib pole 138 may be coupled to a support member 140 by a pivot at a side region of the lower section 160 of the hub rib pole 138 between the first end and the second end of the lower section 160 of the hub rib pole 138. The support member 140 may be pivotably coupled to the side pole 102 by the second bracket 116 mounted on the corresponding side pole 102. Accordingly, the support member 140 may support the weight of the hub rib pole 138 when the canopy frame 100 is in a fully expanded state.

In one or more embodiments, the weight of the hub 142 may be supported by the side poles 102, the hub rib poles 138, the support members 140, and/or edge scissor members when the canopy frame 100 is in the fully expanded state. Therefore, when the canopy frame 100 is in a fully expanded state, the hub 142 may form a peak for supporting a canopy covering resting on or attached to the canopy frame 100. In other words, when the canopy frame 100 is in the fully expanded state, the hub 142 may be at the highest point of the canopy.

When the canopy frame 100 is in a collapsed state, the hub 142 may be lowered such that the hub 142 may be at a height lower than a top end of the side poles 102. Further, to provide a compact form, the hub 142 may be located such that the hub 142 is centered between two adjacent side poles 102 in the collapsed state and off-center with respect to a top down view of the upright canopy frame 100 in the collapsed state.

As shown in FIG. 1, the hub 142 may be positioned between two side poles 102 at the side area corresponding to the long side of the rectangular shaped covered area. However, the present disclosure is not limited thereto. For example, the hub 142 may be positioned between any two side poles 102 of the canopy frame 100 at any side (e.g., a long side or a short side) of the canopy frame 100 with suitable adjustments to the lengths of the components connecting to the hub 142.

In one or more embodiments, each of the side poles 102 may be a telescoping side pole 102 as will be described in more detail below. However, the present disclosure is not limited thereto, and in one or more embodiments, the side poles 102 may not include telescoping sections (i.e., may not be telescoping side poles 102). A telescoping side pole 102 may include two telescoping sections, which correspond to upper section 154 and lower section 156, respectively. The upper and lower sections 154, 156 may be coupled to each other through a height adjustment bracket 152, which may adjust the relative positions of the upper and lower sections 154, 156, and therefore, the height of each telescoping side pole 102.

When the canopy frame 100 is in the fully expanded state, the canopy frame 100 may be selectively set to a lowered configuration at a first height or to a raised configuration at a second height.

In the lowered configuration, the lower section 156 of the telescoping side pole 102 may mostly overlap to fully overlap the upper section 154 of the telescoping side pole 102 in a radial direction (or a thickness direction) of the telescoping side pole 102. In one or more embodiments, the lowered configuration may be reversibly fixed in position by a bottom end of the height adjustment bracket 152 resting against or contacting a foot bracket 130 to support the weight of the canopy covering. However, the present disclosure is not limited thereto, and any suitable locking mechanism may be used. For example, the lowered configuration may be fixed in position by a pin and through hole mechanism at any suitable portion of the telescoping side pole 102 (e.g., a retractable pin extending into a corresponding through hole when the pin of the upper section 154 or lower section 156 aligns with a through hole of the other section). As another example, the lowered configuration may be fixed by the height adjustment bracket 152 including a retractable protrusion which extends to form a friction stop against a portion of the telescoping side pole 102 in accordance with a knob.

In one or more embodiments, when the locking mechanism is disengaged, the lower section 156 of the telescoping side pole 102 may slide away from or slide towards the upper section 154 of the telescoping side pole 102 such that the height of the canopy frame 100 increases or decreases respectively. The lower limit of the height of the canopy frame 100 may be set by the lowered configuration and the upper limit of the height of the canopy frame 100 may be set by the raised configuration.

Therefore, starting from the lowered configuration, the height of the canopy frame 100 may increase until a pin and through hole mechanism (e.g., a pin of an upper section 154 or lower section 156 aligning with a through hole of the other section) reversibly locks the upper section 154 and lower section 156 of the telescoping side pole 102 in position indicating that the canopy frame 100 is at a set height (e.g., a set height for the raised configuration). In one or more embodiments, the total height of the canopy frame 100 in the raised configuration and in a fully expanded state is about 7.1 feet. However, the present disclosure is not limited thereto, and in other embodiments, the height may be any suitable height based on the height of the telescoping side poles 102, hub 142, and the like.

Although two height configurations (e.g., the raised and lowered configuration) are described with reference to FIG. 1, any number of height configurations may be provided as desired with suitable adjustments to the telescoping side poles 102 to fix the telescoping side poles 102 of the canopy frame 100 at a series of set heights including the lowered configuration and the raised configuration. For example, multiple locking mechanisms incrementally set at different heights along the telescoping side poles 102 may be used to provide the series of set heights. As another example, a retractable protrusion which extends to form a friction stop in accordance with a knob at the height adjustment bracket 152 may be used to provide a user-selected height.

In one or more embodiments, the side poles 102 may not be telescoping, and instead may have a fixed length. In this case, one height configuration may be provided.

Figure 2A:
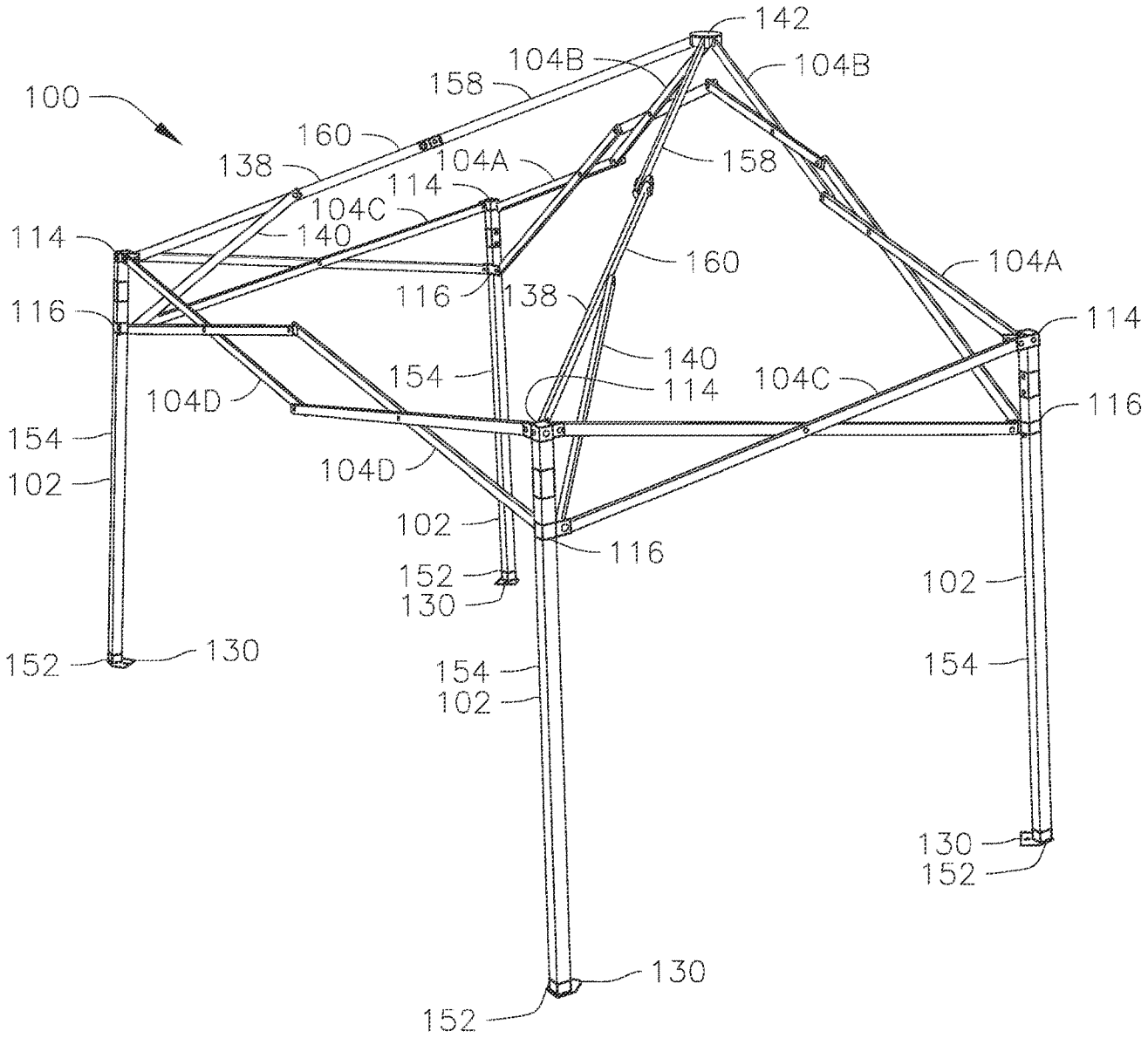
FIG. 2A is a rear perspective view of the canopy frame of FIG. 1 in a fully expanded state and in a lowered configuration.
Figure 2B:
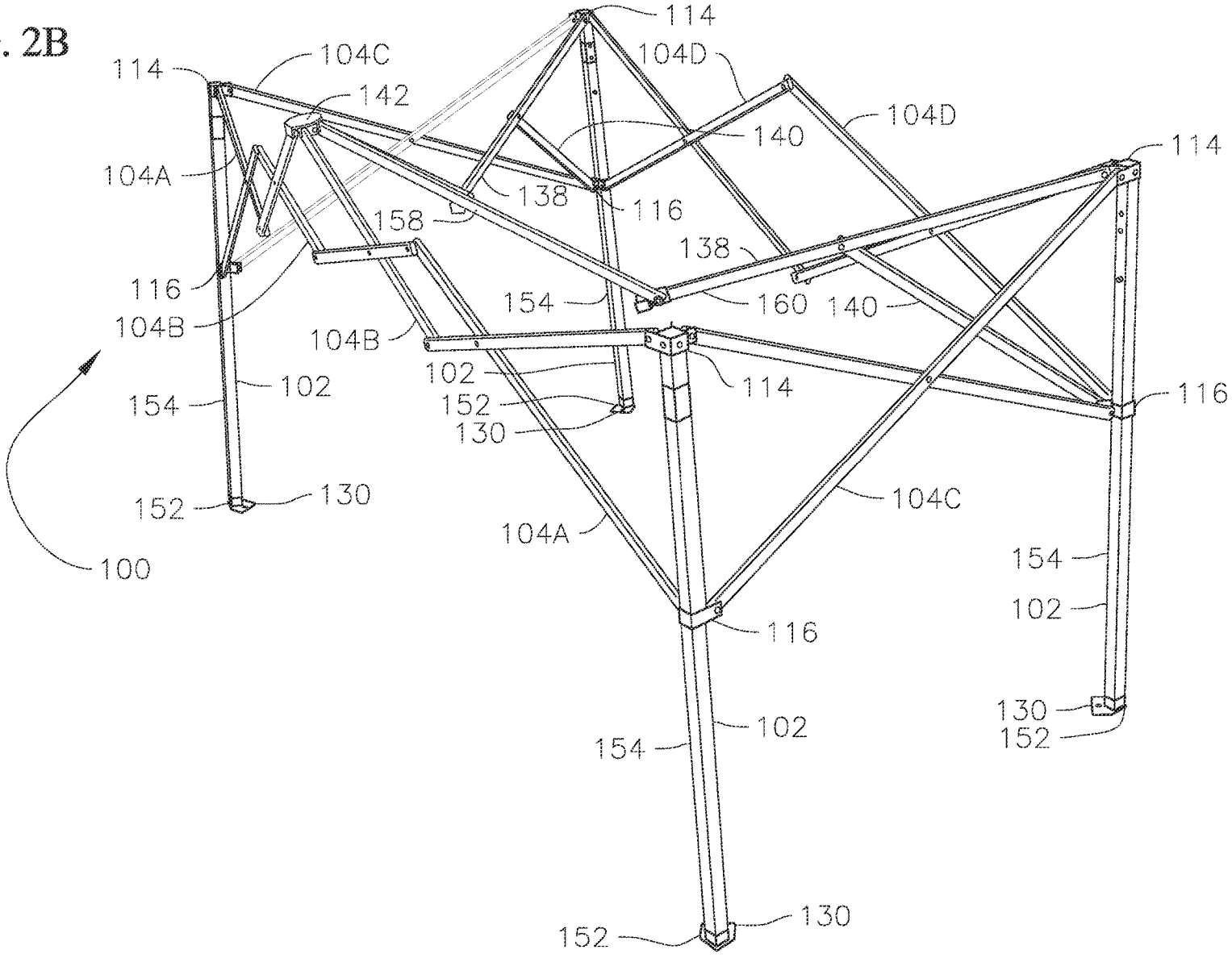
FIGS. 2B-2D are perspective views of the canopy frame of FIG. 2A in partially expanded states according to one or more embodiments of the present disclosure.
Figure 2C:
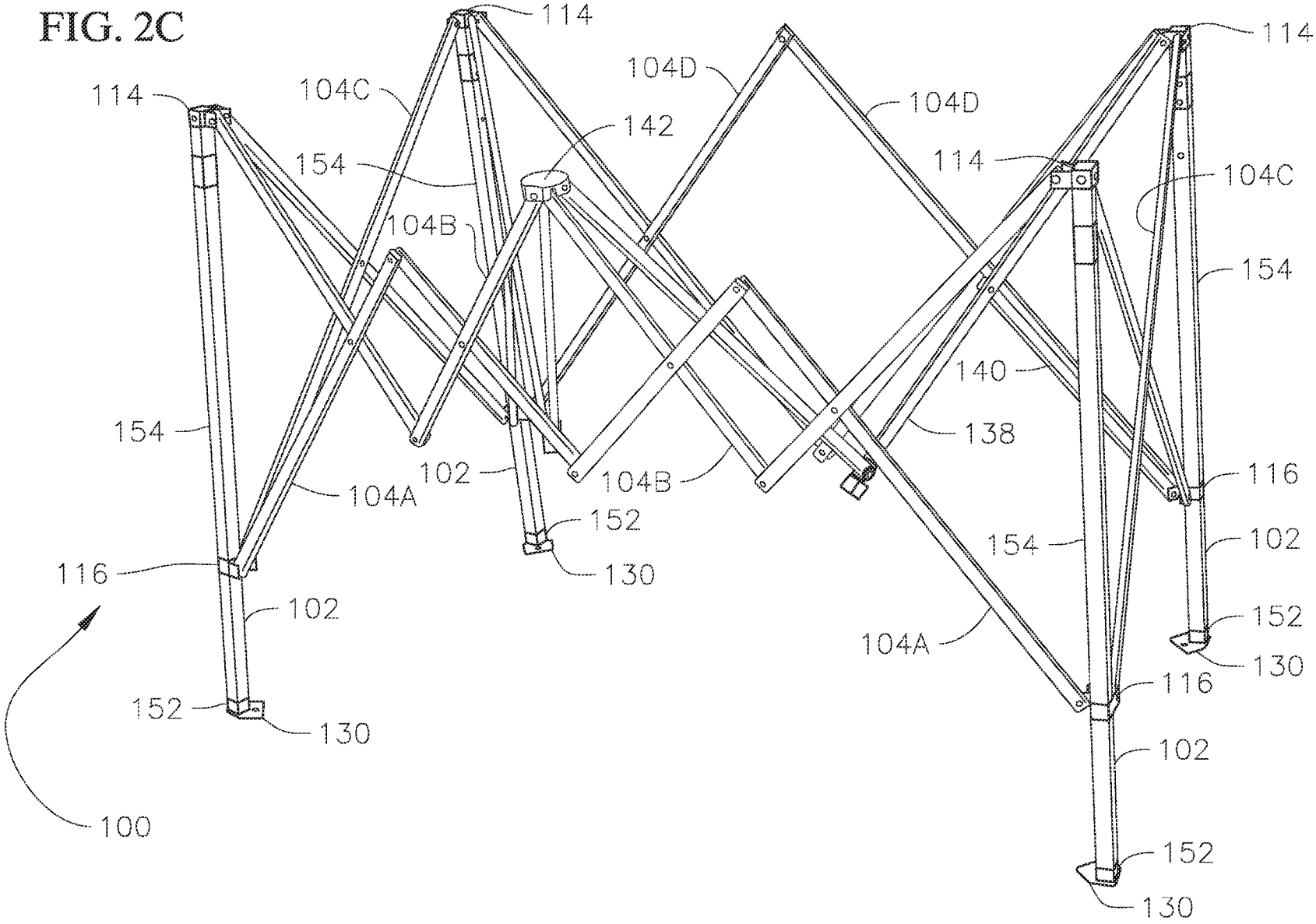
Figure 2D:
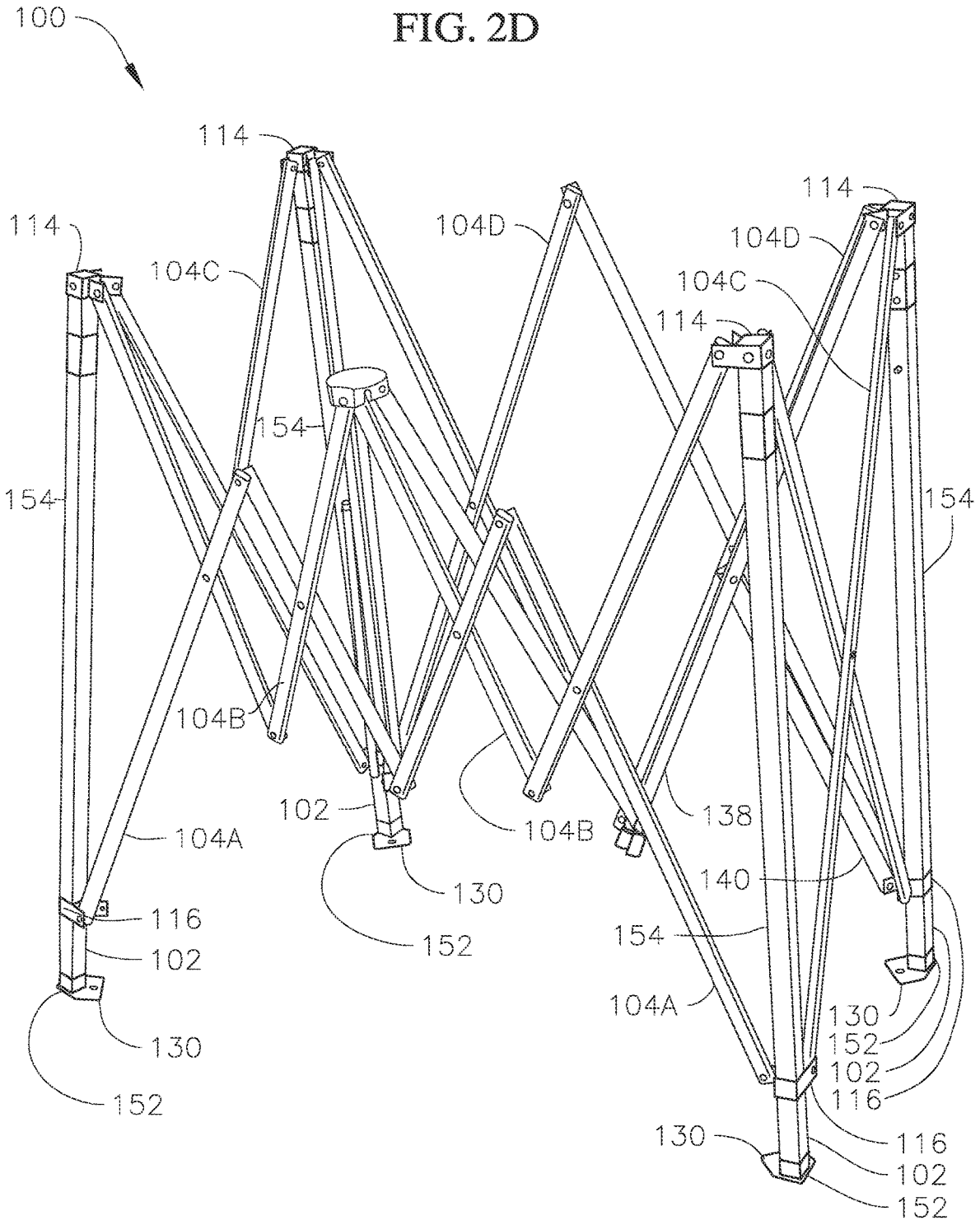
Figure 2E:
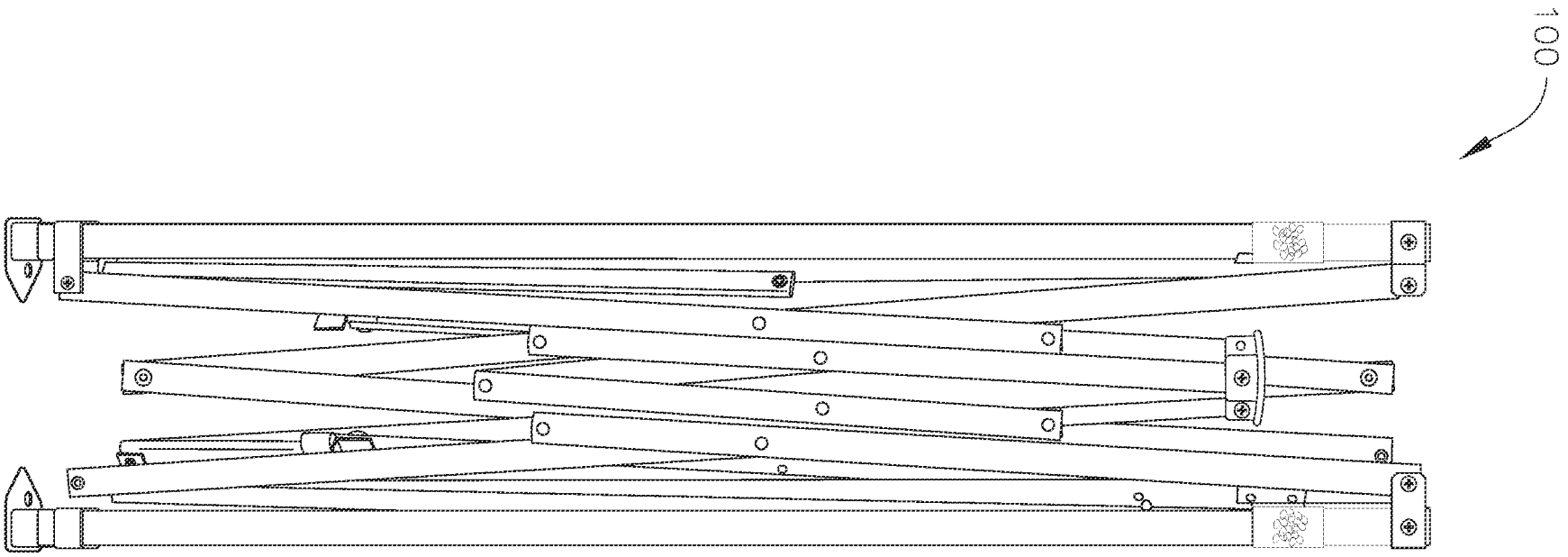
FIG. 2E is a front view of the canopy frame of FIG. 2A in a collapsed state according to one or more embodiments of the present disclosure.

FIG. 2A is a rear perspective view of the canopy frame of FIG. 1 in a fully expanded state and in a lowered configuration; FIGS. 2B-2D are perspective views of the canopy frame of FIG. 2A in partially expanded states according to one or more embodiments of the present disclosure; and FIG. 2E is a front view of the canopy frame of FIG. 2A in a collapsed state according to one or more embodiments of the present disclosure.

Referring to FIGS. 2B-2E, the canopy frame 100 in the lowered configuration may collapse from the fully expanded state to partially expanded states before reaching the collapsed state. Similarly, the canopy frame 100 may expand from the collapsed state to partially expanded states before reaching the fully expanded state.

To collapse the canopy frame 100, the side poles 102 are pushed towards the center of the covered area, forcing second brackets 116 to move away from first brackets 114 as upper and lower ends of the edge scissor members pivotably coupled to the first brackets 114 and second brackets 116 pivot in opposite directions to one another to increase the distance between their respective ends. Meanwhile, each of the second brackets 116 moves downward along the upper section 154 of the side pole 102 towards the height adjustment bracket 152 or the foot bracket 130 and away from the first bracket 114. As the second bracket 116 moves downwardly, second brackets 116 pivotably coupling the support members 140 to side poles 102 may also move or force down the pivot coupling the support members 140 to the lower sections 160 of hub rib poles 138 such that the support members 140 coupled to side poles 102 at second brackets 116 pull the hub rib poles 138 downwardly. The hub rib poles 138 further fold at a pivot between the upper section 158 and the lower section 160, concurrently (e.g., simultaneously) moving the hub 142 coupled to the hub rib poles 138 downwardly. The hub 142 may also be connected between edge scissor assemblies 104A, 104B such that the hub 142 is concurrently (e.g., simultaneously) moved downwardly by the edge scissor assemblies 104A, 104B while the hub rib poles 138 fold at the pivot moving the hub 142 downwardly. In one or more embodiments, the hub 142 may move downwardly due to a difference in length between the scissor members of the pair of intervening edge scissor assemblies 1046 and the scissor members of the pair of edge scissor assemblies 104A. For example, the scissor members of the pair of intervening edge scissor assemblies 1046 may be shorter in length than the scissor members of the pair of edge scissor assemblies 104A as shown in FIGS. 2A-2E.

Accordingly, the canopy frame 100 can thus be completely collapsed. Such a collapsed configuration effectively reduces the volume of the canopy frame 100 and allows a user to easily and conveniently carry the canopy frame 100. In other words, the canopy frame 100 may be in a collapsed state for ease of transport. In the collapsed state, the canopy frame 100 may be more compact (e.g., have a smaller form factor) than the fully expanded state to allow a user to carry the canopy frame 100 or pack the canopy frame 100 into a bag.

As shown in FIG. 2E, the hub 142 of the canopy frame 100 may be at a side of the canopy frame 100 between two side poles 102 to form a compact rectangular shape for storage and/or transport. In the collapsed state, the hub 142 may be at a height between the foot bracket 130 and the top end of each of the side poles 102.

To expand the canopy frame 100 from a collapsed state to the fully opened state, the side poles 102 are pushed or pulled outwardly (e.g., pushed or pulled outwardly at the same time), stretching the canopy frame 100. As the side poles 102 are pushed or pulled outwardly, the second brackets 116 move upward along the side poles 102 while edge scissor members 104A, 104C, 104D pivotably coupled to the first brackets 114 and second brackets 116 pivot in opposite directions to one another to decrease the distance between their respective ends, elongating the edge scissor assemblies 104A, 104B, 104C, 104D. As the second brackets 116 move upwardly along the side poles 102, support members 140 coupled to move with second brackets 116 also move upwardly and push the hub rib poles 138 upward. As the hub rib poles 138 are pushed upwardly, the hub 142 is moved into a vertical supporting position for tautly supporting a canopy covering. In one or more embodiments, the hub 142 may also be connected between edge scissor assemblies 104A, 104B such that the hub 142 is concurrently (e.g., simultaneously) moved upwardly by the edge scissor assemblies 104A, 104B while the hub rib poles 138 move the hub 142 upward.

Figure 3:
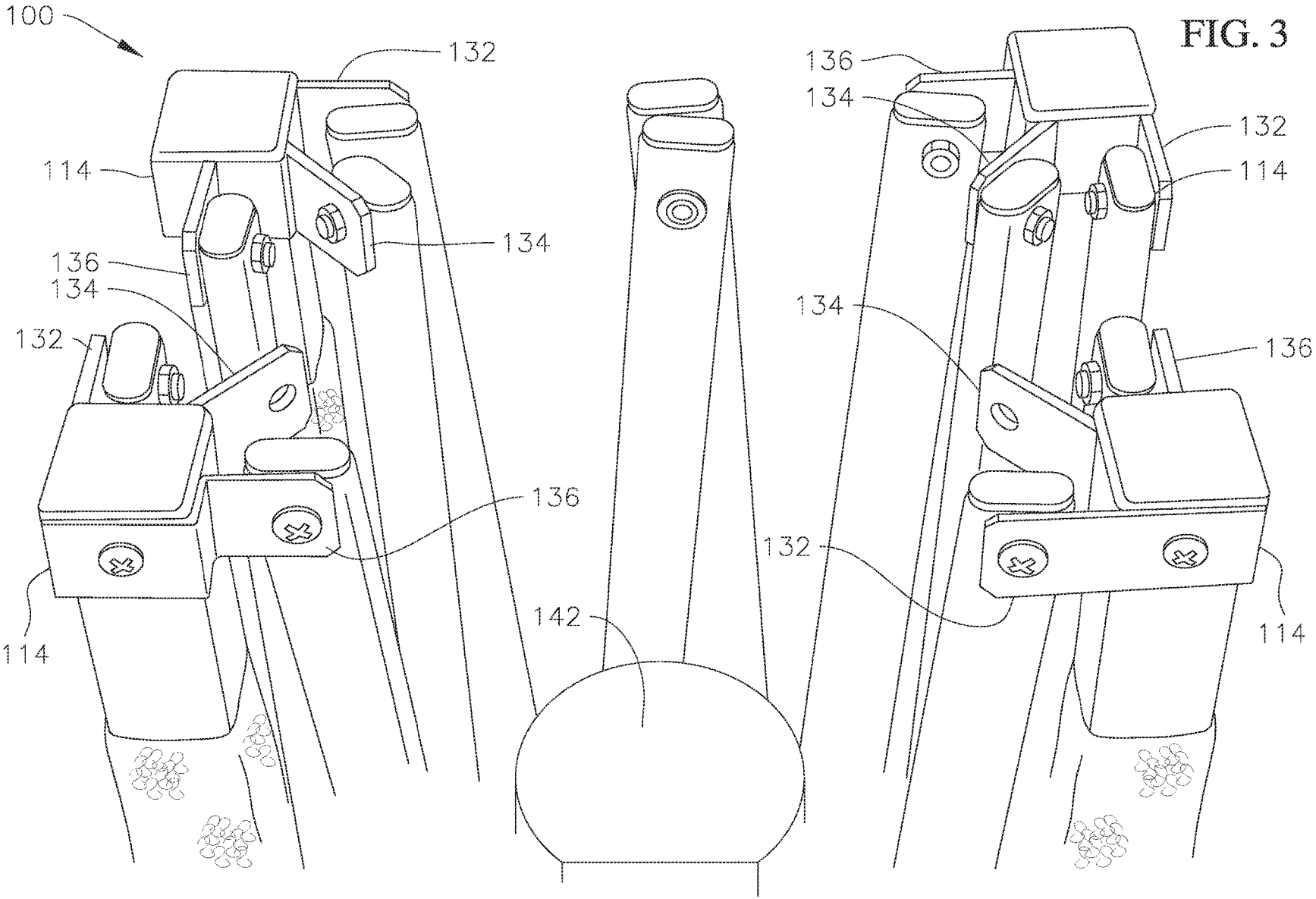
FIG. 3 is a perspective view of an upper portion of a canopy frame including first brackets according to one or more embodiments of the present disclosure.

FIG. 3 is a perspective view of an upper portion of a canopy frame 100 including first brackets according to one or more embodiments of the present disclosure.

Referring to FIG. 3, the structure of each first bracket 114 according to one or more embodiments includes a cavity for receiving a side pole 102 (e.g., the upper section of the side pole), a first connection region 132, a second connection region 134, and a third connection region 136. Each of the first connection region 132, the second connection region 134, and the third connection region 136 may indicate a protrusion of the first bracket 114 including, for example, a through hole to receive a pivot connecting a hub rib pole 138 (e.g., a second end of the lower section of the hub rib pole) or an edge scissor assembly 104A, 104C, 104D (e.g., an upper outer end of the edge scissor assembly) at the corresponding connection region 132, 136. However, the present disclosure is not limited thereto. For example, any other suitable connection mechanism may be used to connect the first bracket 114 to the hub rib pole 138 or the edge scissor assembly 104A, 104C, 104D while enabling the hub rib pole 138 or the edge scissor assembly 104 to pivot about the connection mechanism.

As shown in FIG. 3, side poles 102 at the side area of the canopy frame 100 may only be pivotably coupled to edge scissor assemblies 104A, 104C at the first connection region 132 and the third connection region 136 while the other side poles 102 of the canopy frame 100 may be pivotably coupled to edge scissor assemblies 104C, 104D at the first connection region 132 and the third connection region 136 and pivotably coupled to a hub rib pole 138 at the second connection region 134.

In one or more embodiments, a first protrusion forming the first connection region 132 may extend in a first direction and a third protrusion forming the third connection region 136 may extend in a second direction normal or perpendicular to the first direction. Therefore, the first protrusion and the third protrusion may be separated by a 90 degree or about 90 degree angle. A second protrusion forming the second connection region 134 may extend between the first protrusion and the third protrusion. For example, the second protrusion may be separated by a 45 degree or about 45 degree angle from the first protrusion and/or the third protrusion. Although particular angles are described with reference to the protrusion, the present disclose is not limited thereto. For example, different angles may be used with corresponding changes to components connected at the connection regions.

Figure 4A:
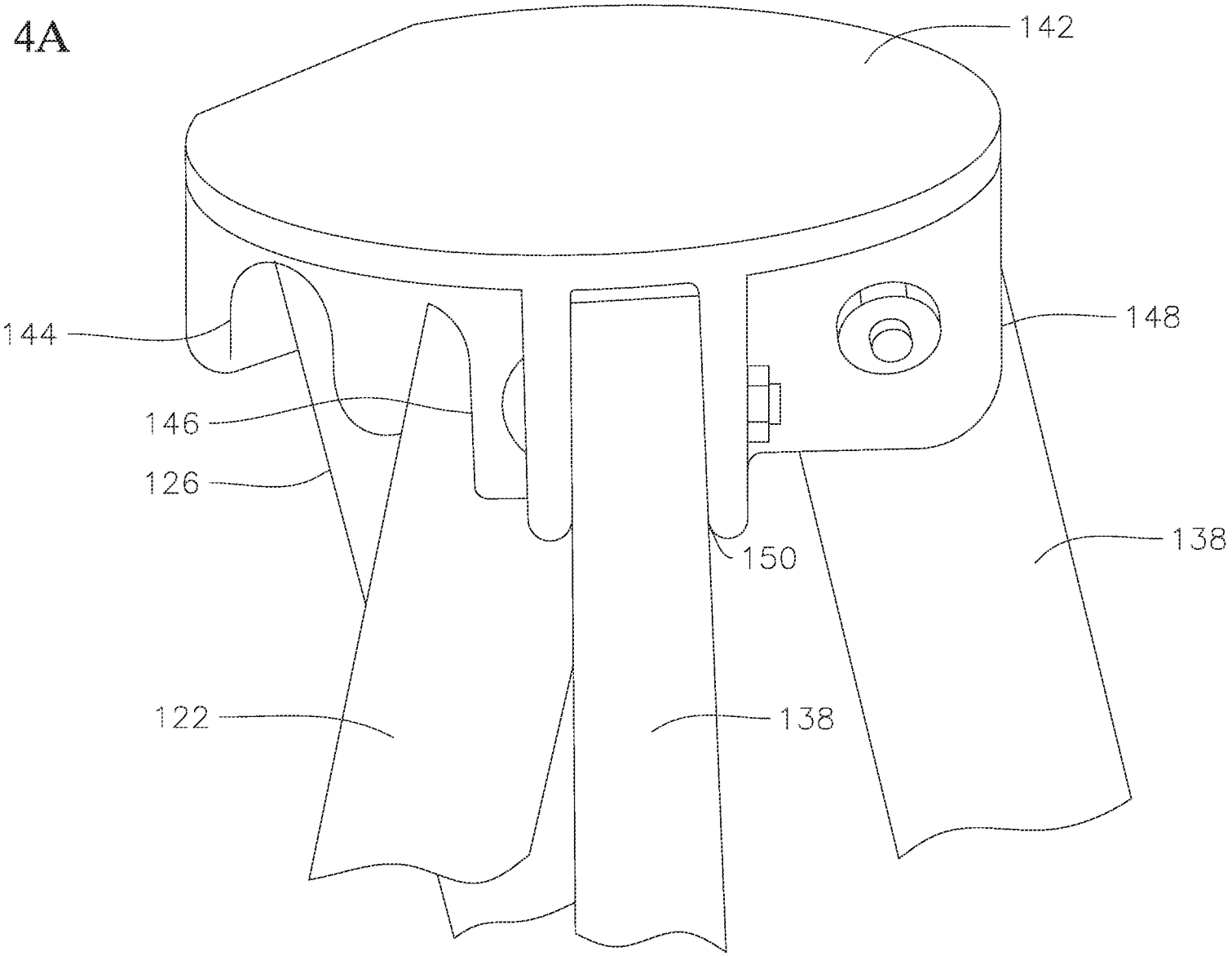
FIG. 4A is a perspective view of a hub according to one or more embodiments of the present disclosure.
Figure 4B:
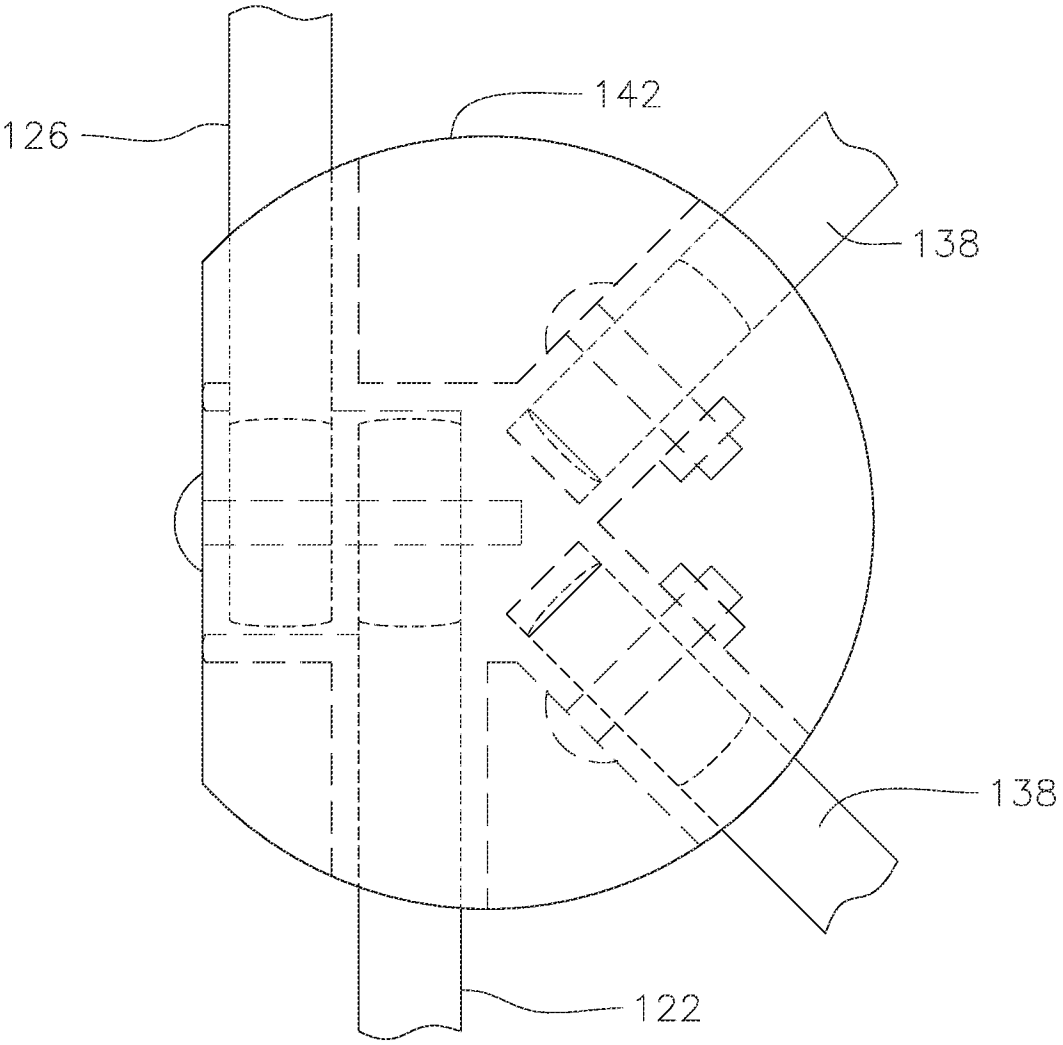
FIG. 4B is a top view of the hub of FIG. 4A.

FIG. 4A is a perspective view of a hub according to one or more embodiments of the present disclosure; and FIG. 4B is a top view of the hub of FIG. 4A.

Referring to FIGS. 4A and 4B, the structure of the hub 142 according to one or more embodiments includes, at an underside of the hub 142, a first coupling support member 144 to receive an edge scissor assembly 104B, a second coupling support member 146 to receive another edge scissor assembly 104B, a third coupling support member 148 to receive a hub rib pole 138, and a fourth coupling support member 150 to receive another hub rib pole 138. Each of the first coupling support member 144 and the second coupling support member 146 may receive an upper end of corresponding edge scissor assemblies 104B, and each of the third coupling support member 148 and the fourth coupling support member 150 may receive a first end of corresponding hub rib poles 138. The first coupling support member 144, the second coupling support member 146, the third coupling support member 148, and the fourth coupling support member 150 may each define a channel extending in a channel direction to receive an end of a corresponding hub rib pole 138 or edge scissor assembly 104B and a through hole extending through the channel walls of the channel in a through hole direction crossing the channel direction, although the present disclosure is not limited thereto. The through hole may be set to receive a pivot such that an end of a hub rib pole 138 or edge scissor assembly 104B may be coupled to the corresponding coupling support member.

In one or more embodiments, the first coupling support member 144 and the second coupling support member 146 may be side-by-side and the through holes of the first coupling support member 144 and the second coupling support member 146 may be aligned such that a single pivot may extend through both through holes, although the present disclosure is not limited thereto. In this case, a single pivot may couple each of the first coupling support member 144 and the second coupling support member 146 and the upper outer ends 122, 126 of the two edge scissor assemblies 104B together.

In one or more embodiments, the channel direction of the first coupling support member 144 and the second coupling support member 146 may be the same direction (e.g., a direction facing side poles adjacent to the hub), and the channel direction of the third coupling support member 148 and the fourth coupling support member 150 may be different directions (e.g., directions facing corresponding side poles 102) from each other and from each of the other coupling support members. Therefore, in one or more embodiments, the third coupling support member 148 and the fourth coupling support member 150 may each receive a separate pivot pivotably coupling corresponding hub rib poles 138 to the third coupling support member 148 and the fourth coupling support member 150.

Figure 5:
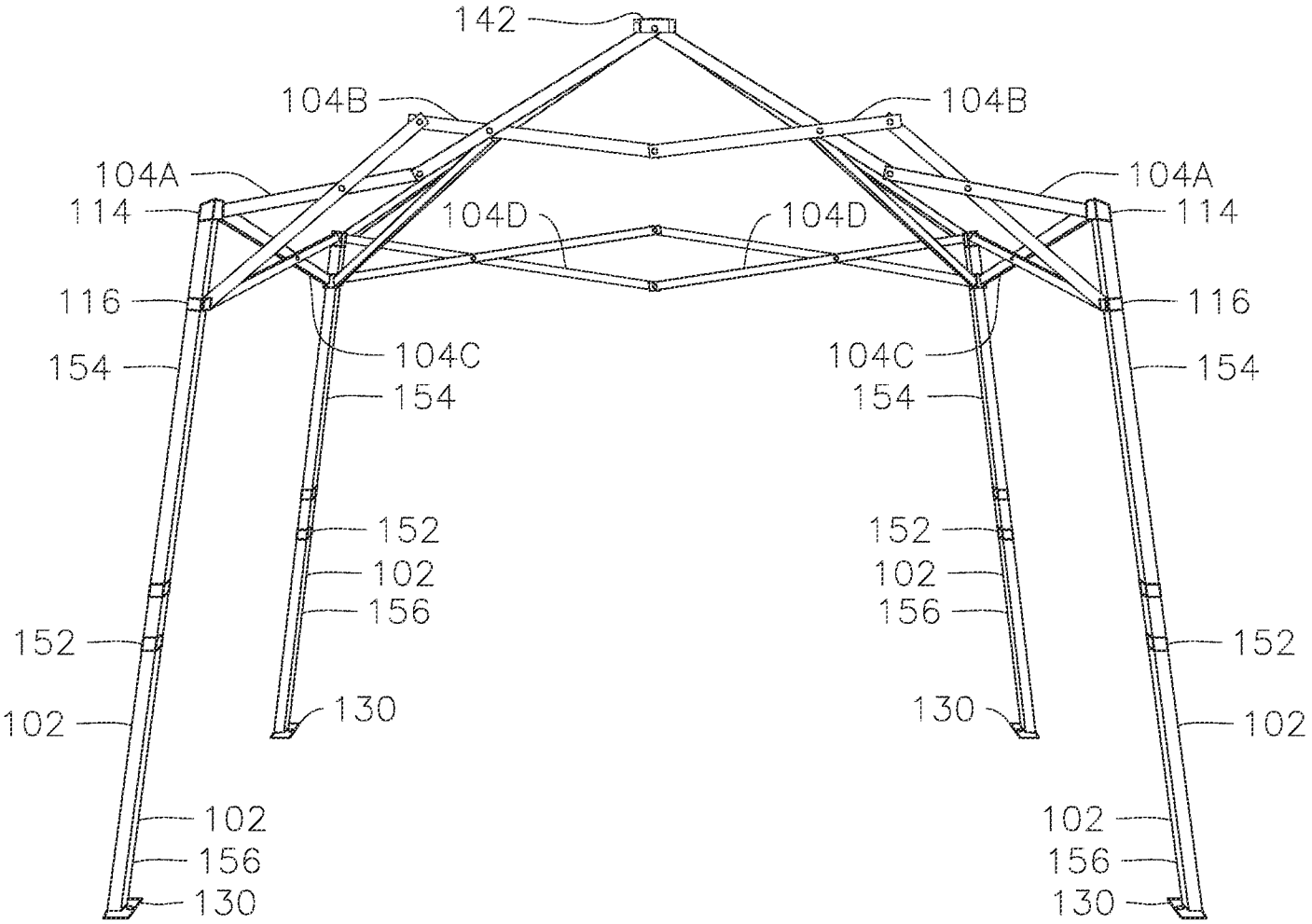
FIG. 5 is a front perspective view of a canopy frame in a fully expanded state and in a raised configuration according to one or more embodiments of the present disclosure.

FIG. 5 is a front perspective view of a canopy frame in a fully expanded state and in a raised configuration according to one or more embodiments of the present disclosure.

Referring to FIG. 5, the collapsible canopy frame 500 may include side poles 102 that are slanted relative to the height direction as opposed to side poles 102 that extend parallel to the height direction as shown in FIG. 1.

Although the canopy frame 500 shown in FIG. 5 includes side poles 102 that are slanted, the same components of the canopy frame 500 function in the same way as the components of the canopy frame 100 described with respect to FIG. 1, and therefore, descriptions of the components may not be repeated.

Figure 6A:
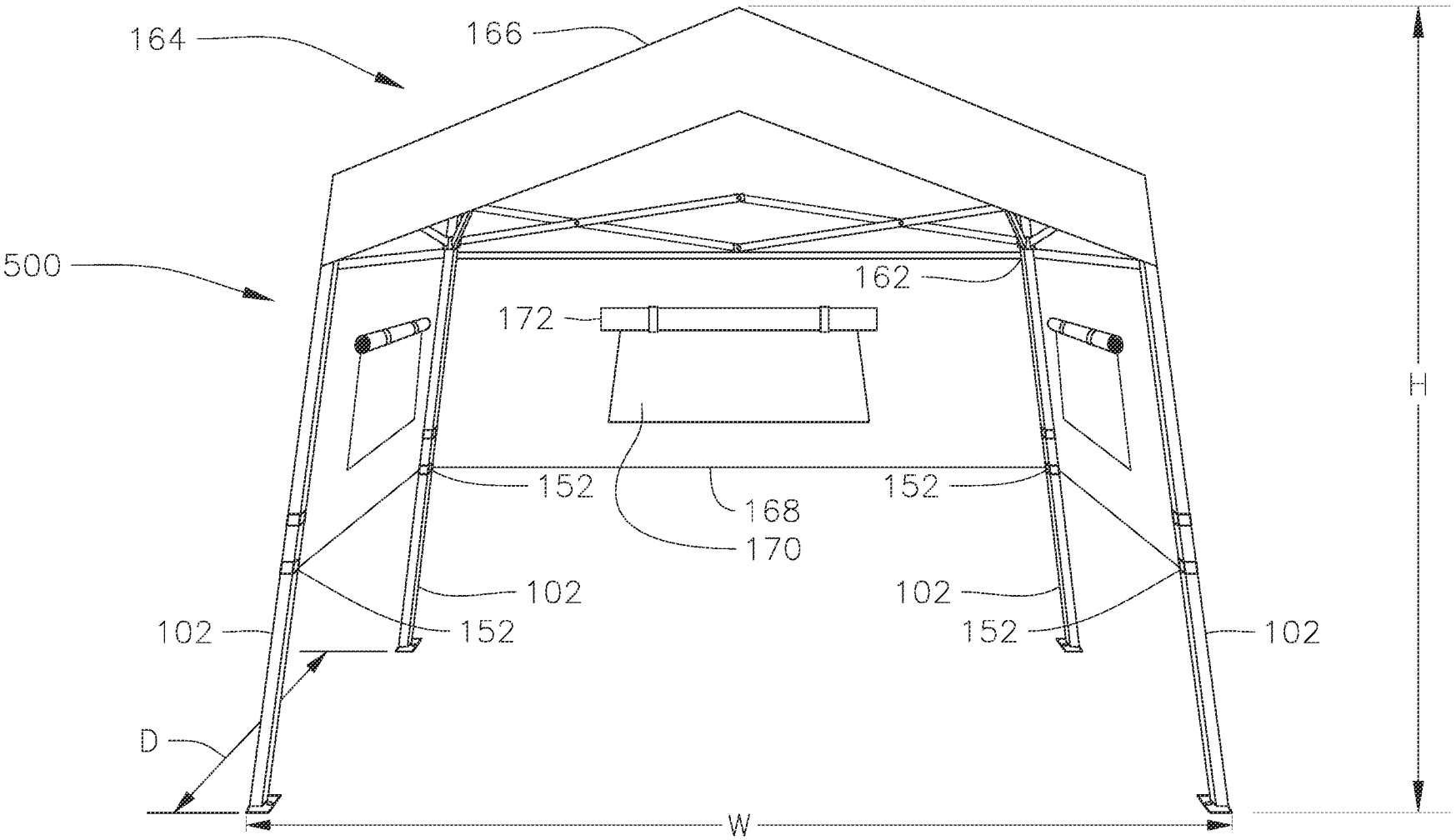
FIG. 6A is a front view of a canopy frame of FIG. 5 in a fully expanded state and in a raised configuration with a canopy covering according to one or more embodiments of the present disclosure.
Figure 6B:
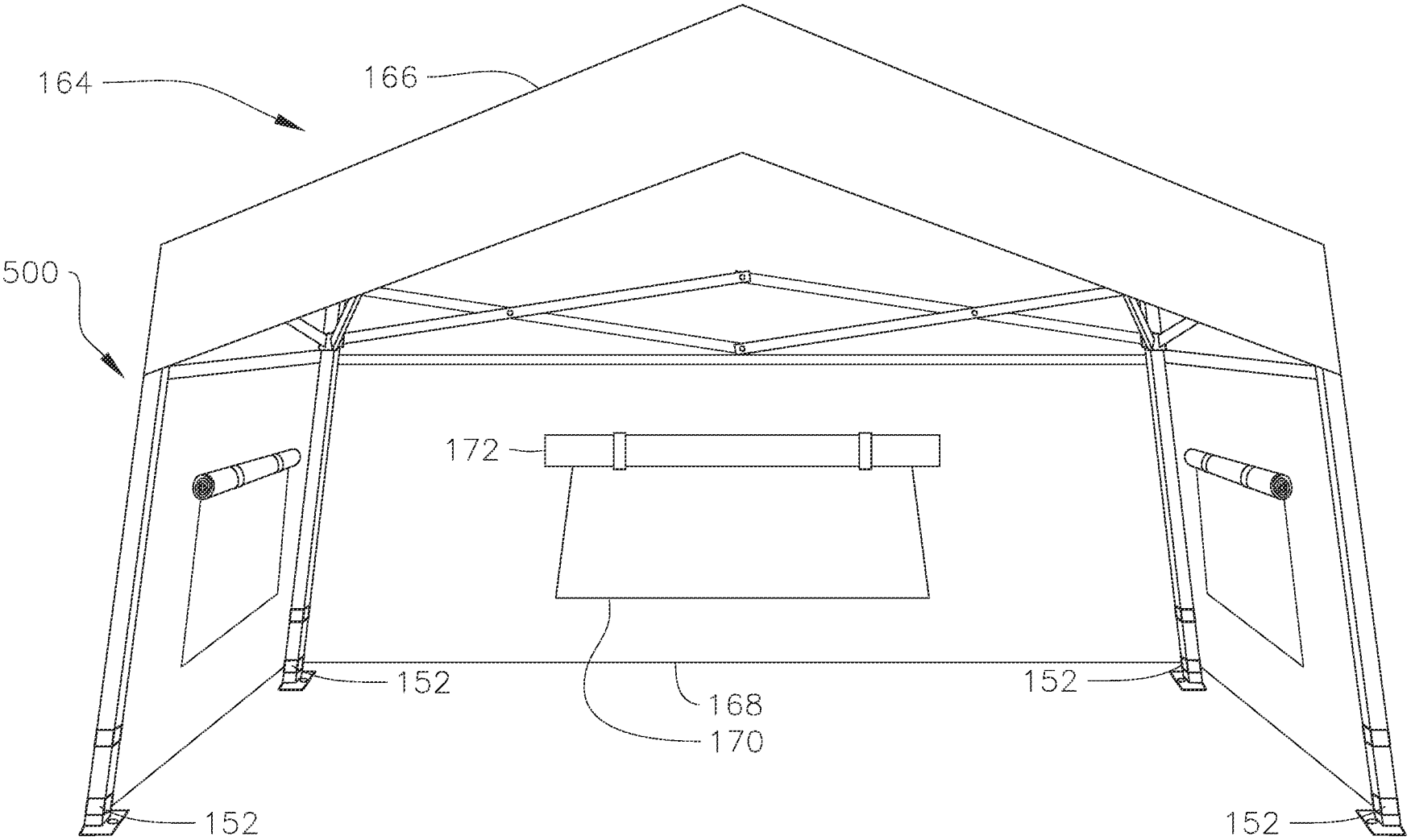
FIG. 6B is a front view of the canopy frame of FIG. 5 in a fully expanded state and in a lowered configuration with a canopy covering.

FIG. 6A is a front view of a canopy frame of FIG. 5 in a fully expanded state and in a raised configuration with a canopy covering according to one or more embodiments of the present disclosure; and FIG. 6B is a front view of the canopy frame of FIG. 5 in a fully expanded state and in a lowered configuration with a canopy covering.

Referring to FIGS. 6A and 6B, one or more of the side poles 102 may include a fastening mechanism 162 at a side region of the side pole 102 between the first bracket 114 attached to the side pole 102 and the foot bracket 130 attached to the side poles 102. The fastening mechanism 162 may be any reversible fastening mechanism 162, such as a hook-and-loop fastener or touch fastener. As shown in FIGS. 6A and 6B, the fastening mechanism 162 may contact the side pole 102 and may fasten a corresponding portion of the canopy covering 164 to the canopy frame 500.

Although a fastening mechanism 162 is shown in FIGS. 6A and 6B, in one or more embodiments, the fastening mechanism 162 may be omitted and the canopy covering 164 may be mounted on the canopy frame 500 without using the fastening mechanism 162.

In one or more embodiments, the canopy covering 164 includes two separate covers, a wall cover 168 and a roof cover 166 (although, in an embodiment, the wall cover and the roof cover may be formed integrally). In this case, the wall cover 168 may wrap around sides of the canopy frame 500 and be fastened to the canopy frame 500 by the one or more fastening mechanisms 162 as shown in FIGS. 6A and 6B, and the roof cover 166 may be mounted on the top of the canopy frame 500 as also shown in FIGS. 6A and 6B. The roof cover 166 may be fastened to the canopy frame 500 at the fastening mechanism 162 such that there is no gap formed between the roof cover 166 and the wall cover 168 at sides of the canopy frame 500 wrapped by the wall cover 168. In other embodiments, the roof cover 166 may be fastened to the wall cover 168 or vice versa to prevent or substantially prevent a gap from being formed between the wall cover 168 and the roof cover 166.

Accordingly, as shown in FIGS. 6A and 6B, the roof cover 166 may cover the top of the canopy frame 500 and upper portions of one or more sides of the canopy frame 500 while the wall cover 168 may cover potential openings or access points allowing access into the area covered by the roof cover 166.

In one or more embodiments, portions of the wall cover 168 may include a window portion 170. The window portion 170 may be a portion of the wall cover 168 including a transparent or translucent material. The wall cover 168 may also include rollable blinds 172 corresponding to each of the window portions 170. The rollable blinds 172 may cover corresponding window portions 170 with a flap of opaque material in an unrolled state, and, in a rolled state, the rollable blinds 172 may be positioned at a side of the window (e.g., a side above the window) such that light may pass through the corresponding window portion 170 without being blocked by the rollable blinds 172. In other embodiments, the window portion 170 may be an opening of the wall cover 168 rather than a portion including a transparent or translucent material.

In one or more embodiments, the wall cover 168 may have a height such that the wall cover 168 touches or nearly touches the ground in the lowered configuration (e.g., see FIG. 6B) but is suspended off the ground in the raised configuration (e.g., see FIG. 6A). By suspending the wall cover 168 off of the ground, a gap defined by the bottom of the wall cover 168 and the ground may be formed. Accordingly, relatively higher windows and greater air flow may be provided when the canopy frame 500 is raised with the wall cover 168 having a height shorter than the height of the canopy frame 500 in the raised configuration.

In one or more embodiments, the width W, the depth D, and the height H shown in FIG. 6A may be about 8.5 feet, about 3.6 feet, and about 7.1 feet respectively. However, the present disclosure is not limited thereto.

Accordingly, as disclosed herein, embodiments of the present disclosure provide a collapsible canopy frame having a strong and stable foundation with reduced size and weight.

Although some example embodiments have been described, those skilled in the art will readily appreciate that various modifications are possible in the example embodiments without departing from the spirit and scope of the present disclosure. It will be understood that descriptions of features or aspects within each embodiment should typically be considered as available for other similar features or aspects in other embodiments, unless otherwise described. Therefore, it is to be understood that the foregoing is illustrative of various example embodiments and is not to be construed as limited to the specific example embodiments disclosed herein, and that various modifications to the disclosed example embodiments, as well as other example embodiments, are intended to be included within the spirit and scope of the present disclosure as set forth in the appended claims, and their equivalents.

What is claimed is:

1. A collapsible canopy frame comprising:

a plurality of side poles comprising a first side pole, a second side pole, and a third side pole;

a first set of edge scissor assemblies coupling the first side pole and the second side pole to each other, the first set of edge scissor assemblies comprising a first scissor assembly;

at least one second edge scissor assembly coupling the second side pole and the third side pole to each other; and a hub coupled to the first side pole and the second side pole by the first set of edge scissor assemblies and coupled to the third side pole by a hub rib pole, the hub rib pole extending between the hub and an upper end of the third side pole, the hub being directly coupled to the first scissor assembly by a pivot, wherein the hub, the first side pole, the second side pole, and the first set of edge scissor assemblies are located at a side area of the canopy frame.

2. The collapsible canopy frame of claim 1, wherein the collapsible canopy frame further comprises a support member coupling the hub rib pole to the third side pole.

3. The collapsible canopy frame of claim 1, wherein each of the side poles is a telescoping side pole.

4. The collapsible canopy frame of claim 1, further comprising a first bracket coupling the hub rib pole to the third side pole.

5. The collapsible canopy frame of claim 1, further comprising a first bracket coupling an upper end of a scissor assembly of the at least one second edge scissor assembly to the third side pole and a second bracket coupling a lower end of the scissor assembly of the at least one second edge scissor assembly to the third side pole.

6. The collapsible canopy frame of claim 5, wherein the second bracket couples a support member to the third side pole.

7. The collapsible canopy frame of claim 5, wherein the first bracket is at or near a top end of the third side pole, and the second bracket is positioned below the first bracket on the third side pole.

8. The collapsible canopy frame of claim 7, wherein the first bracket is fixed to the third side pole.

9. The collapsible canopy frame of claim 7, wherein the second bracket is configured to slide along the third side pole.

10. The collapsible canopy frame of claim 1, wherein the plurality of side poles further comprises a fourth side pole, and wherein the canopy frame further comprises:

a third set of edge scissor assemblies coupling the third side pole and the fourth side pole to each other; and at least one fourth edge scissor assembly coupling the first side pole and the fourth side pole to each other.

11. A collapsible canopy comprising the collapsible canopy frame of claim 1, and a canopy covering on the collapsible canopy frame, wherein the canopy covering comprises a roof portion and a wall portion, and wherein a gap is defined between the wall portion and a lower end of the first side pole of the plurality of side poles when the canopy frame is in a raised configuration.

12. A collapsible canopy frame comprising:

a plurality of side poles comprising a first side pole, a second side pole, and a third side pole;

a first set of edge scissor assemblies coupling the first side pole and the second side pole to each other, the first set of edge scissor assemblies comprising a first scissor assembly;

at least one second edge scissor assembly coupling the second side pole and the third side pole to each other; and a hub coupled to the first side pole and the second side pole by the first set of edge scissor assemblies and coupled to the third side pole by a hub rib pole, the hub rib pole extending between the hub and an upper end of the third side pole, the hub being directly coupled to the first scissor assembly by a pivot, wherein the first set of edge scissor assemblies coupling the first side pole and the second side pole to each other further comprises a second scissor assembly, a third scissor assembly, and a fourth scissor assembly, and wherein the second scissor assembly, the first scissor assembly, the third scissor assembly, and the fourth scissor assembly are sequentially arranged to couple the first side pole and the second side pole to each other.

13. A collapsible canopy frame comprising:

a plurality of side poles comprising a first side pole, a second side pole, and a third side pole;

a first set of edge scissor assemblies coupling the first side pole and the second side pole to each other;

at least one second edge scissor assembly coupling the second side pole and the third side pole to each other; and a hub coupled to the first side pole and the second side pole by the first set of edge scissor assemblies and coupled to the third side pole by a hub rib pole, the hub rib pole extending between the hub and an upper end of the third side pole, wherein the first set of edge scissor assemblies coupling the first side pole and the second side pole to each other comprises a first scissor assembly, a second scissor assembly, a third scissor assembly, and a fourth scissor assembly sequentially arranged to couple the first side pole and the second side pole to each other, and wherein the hub is coupled to an upper end of the second scissor assembly and an upper end of the third scissor assembly.

14. The collapsible canopy frame of claim 13, wherein the first scissor assembly and the fourth scissor assembly have a same length.

15. The collapsible canopy frame of claim 13, wherein the second scissor assembly and the third scissor assembly have a same length.

16. The collapsible canopy frame of claim 13, wherein the first scissor assembly and the second scissor assembly are different in length.

17. The collapsible canopy frame of claim 16, wherein the first scissor assembly is greater in length than the second scissor assembly.

18. A collapsible canopy frame comprising:

a plurality of side poles comprising a first side pole, a second side pole, and a third side pole;

a first set of edge scissor assemblies coupling the first side pole and the second side pole to each other, the first set of edge scissor assemblies comprising a first scissor assembly;

at least one second edge scissor assembly coupling the second side pole and the third side pole to each other; and a hub coupled to the first side pole and the second side pole by the first set of edge scissor assemblies and coupled to the third side pole by a hub rib pole, the hub rib pole extending between the hub and an upper end of the third side pole, the hub being directly coupled to the first scissor assembly by a pivot, wherein the plurality of side poles further comprises a fourth side pole, wherein the canopy frame further comprises:

a third set of edge scissor assemblies coupling the third side pole and the fourth side pole to each other; and at least one fourth edge scissor assembly coupling the first side pole and the fourth side pole to each other, and wherein the third set of edge scissor assemblies comprises a different number of edge scissor assemblies than the first set of edge scissor assemblies.

19. A collapsible canopy frame comprising:

a plurality of side poles comprising a first side pole, a second side pole, and a third side pole;

a first set of edge scissor assemblies coupling the first side pole and the second side pole to each other;

at least one second edge scissor assembly coupling the second side pole and the third side pole to each other; and a hub coupled to the first side pole and the second side pole by the first set of edge scissor assemblies and coupled to the third side pole by a hub rib pole, the hub rib pole extending between the hub and an upper end of the third side pole, wherein the plurality of side poles further comprises a fourth side pole, wherein the canopy frame further comprises:

a third set of edge scissor assemblies coupling the third side pole and the fourth side pole to each other; and at least one fourth edge scissor assembly coupling the first side pole and the fourth side pole to each other, wherein the third set of edge scissor assemblies comprises a different number of edge scissor assemblies than the first set of edge scissor assemblies, and wherein the first side pole and the second side pole are spaced apart from each other by a same distance as the third side pole and the fourth side pole when the canopy frame is in an expanded state.

* * * * *